US008596812B2

(12) United States Patent
Yeh

(10) Patent No.: US 8,596,812 B2
(45) Date of Patent: Dec. 3, 2013

(54) FLASHLIGHT SWITCHING STRUCTURE

(75) Inventor: Hsueh-Chu Yeh, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 224 days.

(21) Appl. No.: 13/326,395

(22) Filed: Dec. 15, 2011

(65) Prior Publication Data

US 2013/0155700 A1 Jun. 20, 2013

(51) Int. Cl.
*F21L 4/04* (2006.01)

(52) U.S. Cl.
USPC .. 362/205; 362/394; 362/249.05; 362/249.12

(58) Field of Classification Search
USPC ..... 362/205, 249.05, 249.12, 394
See application file for complete search history.

(56) References Cited

U.S. PATENT DOCUMENTS

| | | | | |
|---|---|---|---|---|
| 4,760,504 | A * | 7/1988 | Schaller et al. | 362/205 |
| 7,220,016 | B2 * | 5/2007 | Matthews et al. | 362/205 |
| 2006/0193129 | A1 * | 8/2006 | Opolka | 362/205 |

* cited by examiner

*Primary Examiner* — Sean Gramling
(74) *Attorney, Agent, or Firm* — Alan Kamrath; Kamrath IP Lawfirm, P.A.

(57) ABSTRACT

A flashlight switching structure is provided. To turn on or off a flashlight, an annular element mounted around a neck of the flashlight is manually rotated, thereby driving a magnet connected to the annular element to a position where a reed switch connected to a positioning element in the flashlight is subjected to magnetic attraction of the magnet. Once the annular element is released, the restoring force of a resilient element pushes the magnet back in place. Hence, by rotating and releasing the annular element, the flashlight can be switched between predetermined lighting modes, such as a strong light, weak light, flashing, and turned off mode. When a protruding block connected to the outer periphery of the annular element is pushed downward and partially into a corresponding recess on the flashlight, the annular element is prevented from rotation, and the flashlight from being inadvertently triggered.

4 Claims, 6 Drawing Sheets

FLASHLIGHT SWITCHING STRUCTURE

BACKGROUND OF THE INVENTION

1. Technical Field

The present invention relates to a flashlight switching structure. More particularly, the present invention relates to a flashlight switching structure which allows a flashlight to be turned on and off by manually rotating an annular element which is mounted around one end of a neck of the flashlight. When the annular element is rotated, a magnet connected thereto can be moved to a position where a reed switch connected a positioning element in the flashlight is subjected to magnetic attraction of the magnet, and when the annular element is released, the magnet is driven back to its original position by the restoring force of a resilient element. Thus, by rotating and releasing the annular element, the flashlight can be switched between predetermined lighting modes such as a strong light, weak light, flashing, and turned off mode. Additionally, when a protruding block connected to the outer periphery of the annular element is pushed downward and partially into a corresponding recess on the flashlight, the annular element is kept from rotation, and the flashlight from being inadvertently triggered.

2. Description of Related Art

Nowadays, a flashlight for illumination purposes is typically turned on and off via a switch provided on the surface of the main body of the flashlight, and yet the way the switch is provided tends to compromise watertightness of the flashlight. Therefore, it is an important issue in the flashlight industry to design flashlight switches that are both watertight and easy to operate. To achieve this end, some flashlight switches are provided on the flashlight handles, and some at the rear ends of the handles. These switches are configured for being pushed forward and backward or being pressed repeatedly so as to switch light on and off.

BRIEF SUMMARY OF THE INVENTION

The present invention provides an improvement over the conventional control elements for switching the lighting modes of a flashlight designed for illumination purposes. It is desirable that a flashlight can be switched on and off by manually rotating an annular element which is mounted around one end of a neck of the flashlight. By rotating the annular element, a magnet connected thereto can be driven to a position where a reed switch connected to a positioning element in the flashlight main body is subjected to magnetic attraction of the magnet. By subsequently releasing the annular element, the magnet is driven back to its original position by the restoring force of a resilient element. Thus, the flashlight can be switched between predetermined lighting modes (e.g., a strong light mode, a weak light mode, a flashing mode, and a turned off mode) simply by rotating and releasing the annular element. In addition, when a protruding block connected to the outer periphery of the annular element is pushed downward and partially into a corresponding recess on the flashlight main body, the annular element is prevented from being rotated, and the flashlight is therefore kept from being inadvertently triggered.

The primary object of the present invention is to provide a flashlight having a main body and a light switching assembly. The light switching assembly is threadedly connected to the upper end of a neck of the main body and includes a positioning element, a plate connected with a reed switch, a partition plate, an annular element, a resilient element, and a cap. The positioning element has an upper section to which the plate connected with the reed switch and the partition plate are connected, wherein the plate connected with the reed switch and the partition plate are spaced from each other. The positioning element is received in a space formed at the upper end of the main body. A magnet is connected to the inner periphery of the annular element at a predetermined position. The annular element is mounted around an upper section of a flange provided at the lower end of the neck of the main body. The flange has a predetermined section formed with a groove. The groove corresponds in position to the annular element and is configured for receiving the resilient element, thus allowing the annular element to be resiliently rotated with respect to the main body. The outer periphery of the annular element is formed with a receiving space which is relatively narrow toward the outside and relatively wide toward the inside. When the receiving space is aligned with a recess concavely provided at a predetermined peripheral portion of the main body, a protruding block can engage with both the receiving space and the recess to prevent the annular element from rotation. The inner periphery of the cap is formed with a threaded section to be connected threadedly with an externally threaded portion at the upper end of the neck of the main body. The annular element can be manually turned so that the magnet connected thereto is driven to a position in which the reed switch connected to the positioning element in the main body is subjected to magnetic attraction of the magnet. When the annular element is subsequently released, the restoring force of the resilient element drives the magnet back to its original position. Thus, by turning and releasing the annular element, the flashlight can be switched between predetermined lighting modes such as a strong light mode, a weak light mode, a flashing mode, and a turned off mode.

The second object of the present invention is to provide the foregoing flashlight, wherein the protruding block is received in the receiving space which diminishes in size outward and which is provided on the outer periphery of the annular element. When the protruding block is moved partially into the recess at the predetermined peripheral portion of the main body upon alignment between the receiving space and the recess, the annular element is prevented from rotation, and therefore the flashlight is prevented from being accidently triggered.

The third object of the present invention is to provide the foregoing flashlight, wherein the resilient element received in the groove formed in the predetermined section of the flange is a spring.

The fourth object of the present invention is to provide the foregoing flashlight, wherein the upper section of the positioning element received in the space at the upper end of the main body is provided with two relatively low projections which are opposite to each other and two relatively high projections which are opposite to each other and alternate with the relatively low projections. These projections allow the plate connected with the reed switch and the partition plate to be spaced from each other when connected to the upper section of the positioning element. Furthermore, a plurality of pressing portions are provided along the upper periphery of the positioning element at a predetermined spacing and project outward so that the positioning element can fit tightly in the space at the upper end of the main body.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 1:
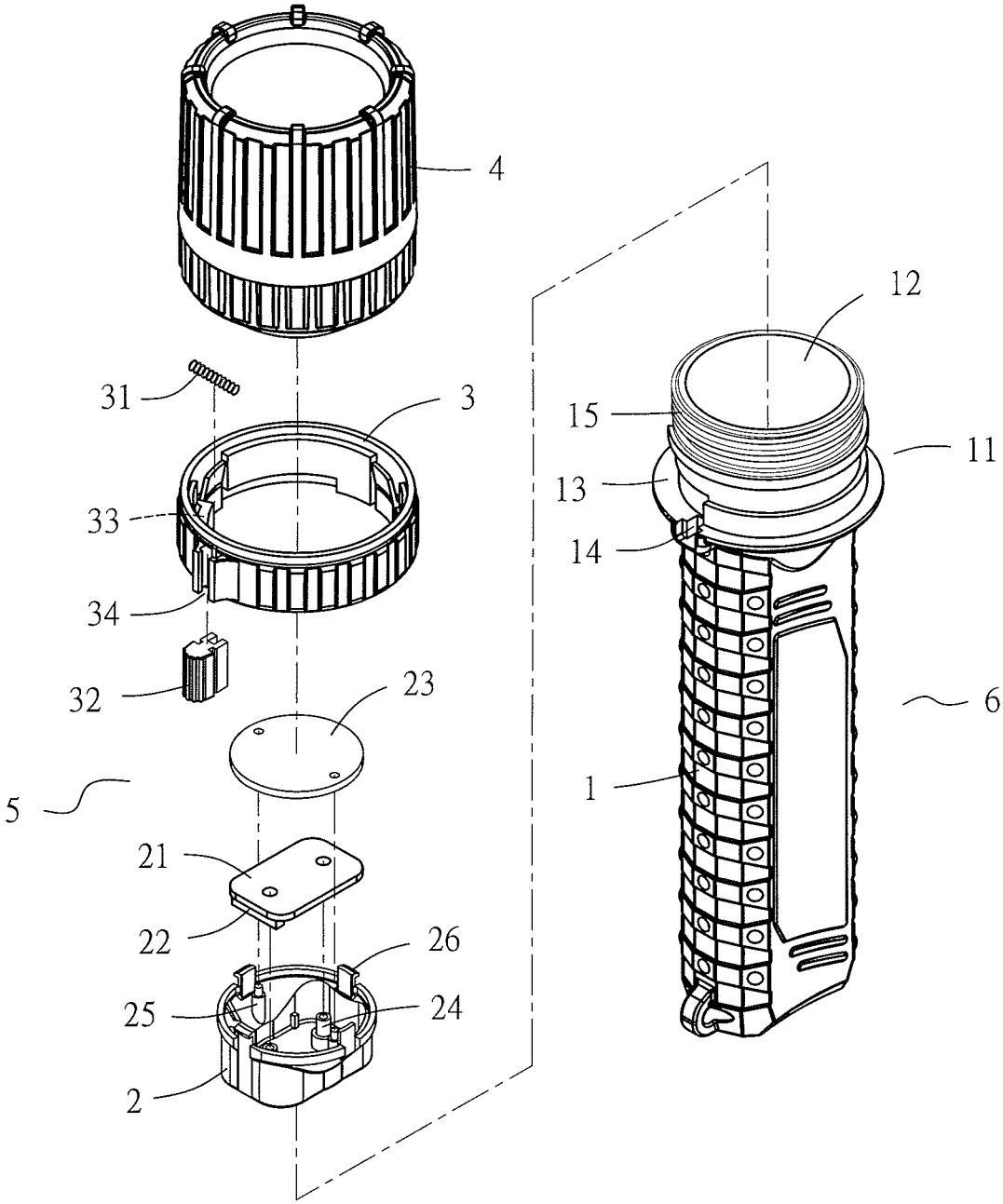
FIG. 1 is an exploded perspective view of a flashlight according to the present invention.

Please refer to FIG. 1 for a flashlight switching structure according to the present invention. As shown in the drawing, the flashlight 6 includes a main body 1 and a light switching assembly 5. The light switching assembly 5 is threadedly connected to the upper end of the neck 11 of the main body 1 and includes a positioning element 2, a plate 21 connected with a reed switch 22, a partition plate 23, an annular element 3, a resilient element 31, a protruding block 32, and a cap 4.

The main body 1 is a flashlight main body in which a battery pack and conductive components are received. The main body 1 forms a space 12 at the upper end. The lower end of the neck 11 is provided with a flange 13 which separates the neck 11 from the rest of the main body 1 and which has a predetermined section formed with a recess 14. The upper end of the neck 11 is provided with an externally threaded portion 15.

The positioning element 2 is a connecting element shaped according to the space 12 at the upper end of the main body 1. Two relatively low projections 24 extend from an upper section of the positioning element 2 and are opposite each other. Also extending from the upper section of the positioning element 2 are two relatively high projections 25 which are opposite each other and alternate with the projections 24. The plate 21 connected with the reed switch 22 and the partition plate 23 are connected to the projections 24 and 25 respectively and are therefore spaced from each other. In addition, a plurality of pressing portions 26 are provided along the upper periphery of the positioning element 2 at a predetermined spacing and project outward so that the positioning element 2, once placed in the space 12 at the upper end of the main body 1, fits tightly therein.

The annular element 3 is a rotatable ring shaped according to an upper section of the flange 13 at the lower end of the neck 11. A magnet 33 is provided at a predetermined position on the inner periphery of the annular element 3. In addition, a receiving space 34 is formed on the outer periphery of the annular element 3, diminishes in size toward the outside, and serves to receive the protruding block 32.

The cap 4 is a flashlight cap shaped according to the externally threaded portion 15 at the upper end of the neck 11. The inner periphery of the cap 4 is provided with a threaded section (not shown).

Figure 2:
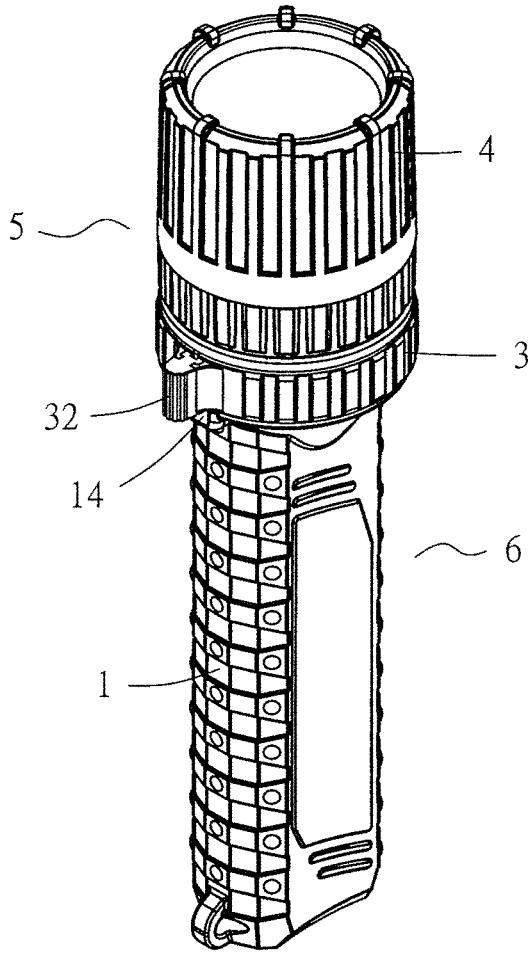
FIG. 2 is an assembled perspective view of the flashlight according to the present invention.
Figure 3:
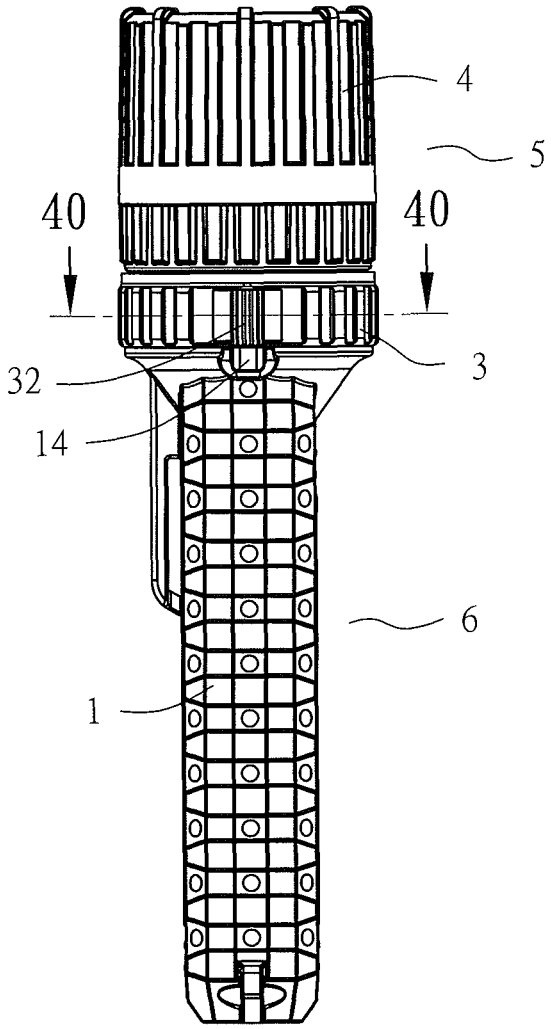
FIG. 3 is a front elevation of the flashlight according to the present invention.
Figure 4:
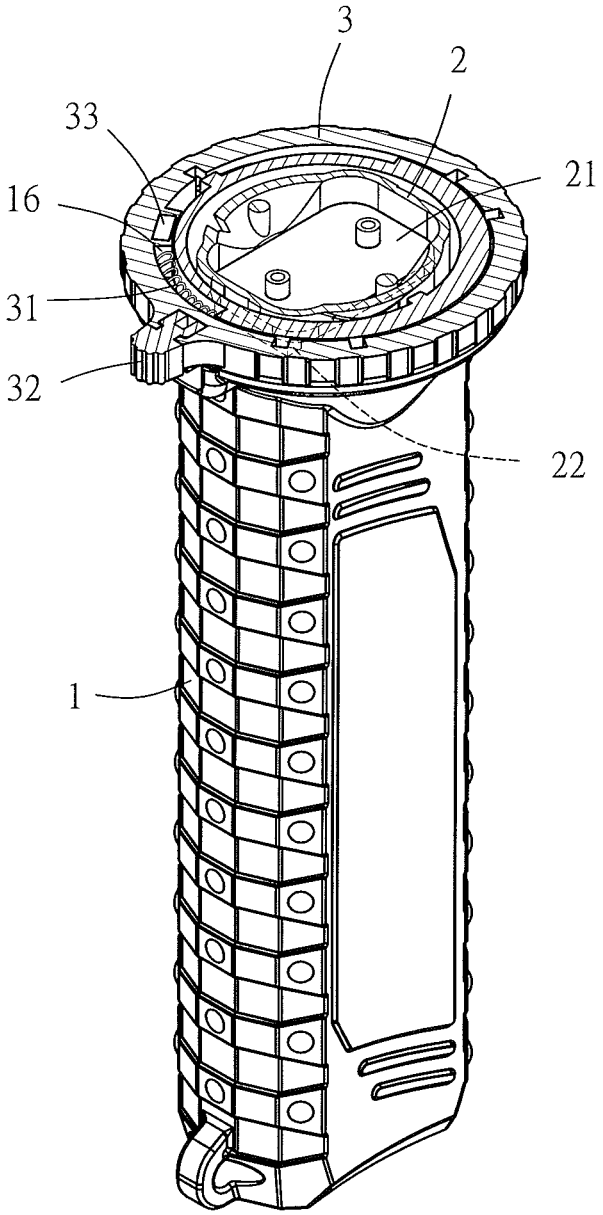
FIG. 4 is a sectional view taken along the line 40-40 of FIG. 3.

The main body 1, the positioning element 2, the annular element 3, and the cap 4 are put together as follows. Referring to FIGS. 1 through 4, the first step is to place the positioning element 2 (with the reed switch 22-loaded plate 21 and the partition plate 23 connected to the positioning element 2 in advance in the spaced configuration described above) into the space 12 at the upper end of the main body 1. In doing so, the pressing portions 26 projecting outward from the upper periphery of the positioning element 2 are pressed tightly against the inner wall of the space 12 of the main body 1. The second step is to mount the annular element 3 around the upper section of the flange 13 at the lower end of the neck 11, and to fit the resilient element 31 (implemented herein by a spring) into a groove 16 formed in a predetermined section of the flange 13 of the main body 1 that corresponds in position to the annular element 3, as shown in FIG. 4, thus allowing the annular element 3 to rotate resiliently with respect to the main body 1. Additionally, the protruding block 32 is inserted into and thus received in the receiving space 34 on the outer periphery of the annular element 3, as shown in FIG. 2. The third and final step is to screw the cap 4 onto the externally threaded portion 15 at the upper end of the neck 11 via the threaded section on the inner periphery of the cap 4. Thus, the light switching assembly 5 and the main body 1 are assembled together to form the flashlight 6, as shown in FIG. 3.

Figure 5:
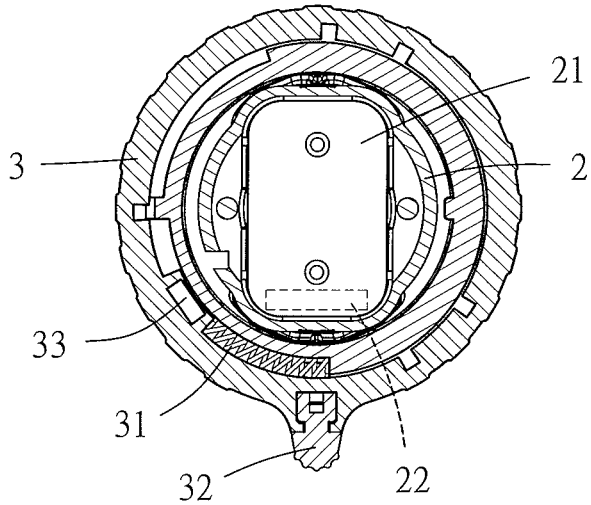
FIG. 5 is a top view of the flashlight shown in FIG. 4.
Figure 6:
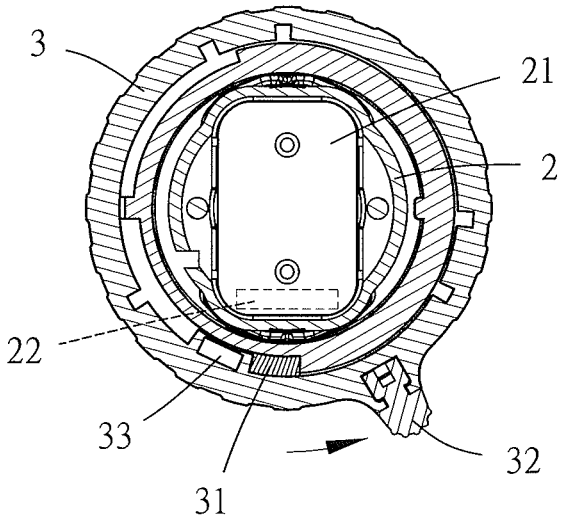
FIG. 6 illustrates how the annular element in FIG. 5 is rotated to turn on the flashlight.

The light switching assembly 5 at the upper end of the flashlight 6 is operated in the following manner. Referring to FIGS. 5 and 6, the annular element 3 is manually rotated to displace the magnet 33 connected thereto (as indicated by the arrow in FIG. 6). When the magnet 33 is moved to a certain position, the reed switch 22 connected to the positioning element 2 in the main body 1 is subjected to magnetic attraction of the magnet 33. Then, the annular element 3 is released, allowing the restoring force of the resilient element 31 to drive the annular element 3, and hence the magnet 33, back to the original position, as shown in FIG. 5. Therefore, by rotating and releasing the annular element 3, the flashlight 6 can be switched between predetermined lighting modes, such as a strong light mode, a weak light mode, a flashing mode, and a turned off mode.

Figure 7:
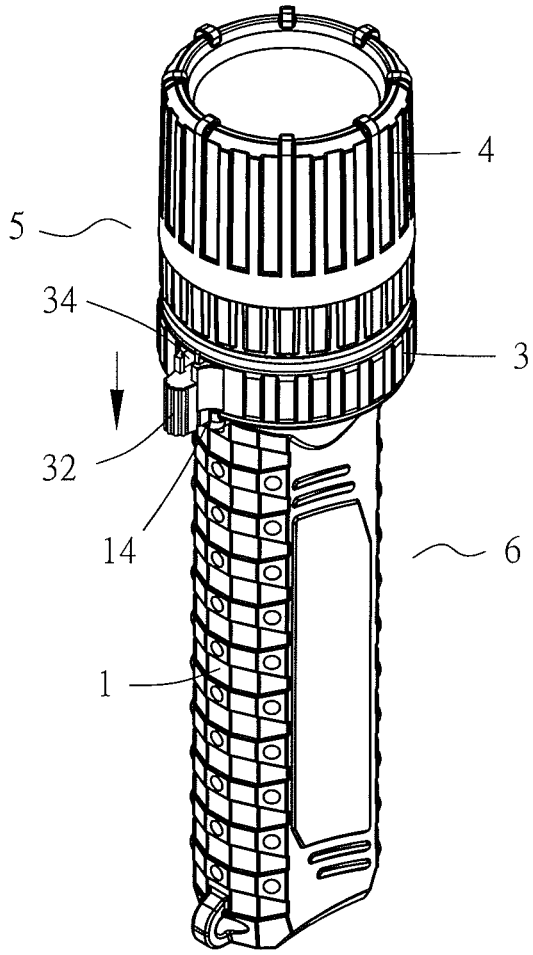
FIG. 7 shows how a protruding block of the flashlight of the present invention is pushed downward and partially into a recess in the main body of the flashlight.

When it is desired to keep the flashlight 6 in a certain lighting mode temporarily, referring to FIG. 7, the protruding block 32 received in the receiving space 34 on the outer periphery of the annular element 3 can be aligned with and then directly and partially moved into the recess 14 formed at a predetermined peripheral portion of the main body 1. Consequently, the annular element 3 is prevented from rotation, and the flashlight 6 from being inadvertently triggered.

To restore the rotating switching function of the light switching assembly 5 of the flashlight 6, the user only has to push upward the protruding block 32 which is partially received in the recess 14 of the main body 1, as shown in FIG. 2, and the annular element 3 can once again be rotated and be pushed back in place by the resilient element 31, so as to enable switching between the predetermined lighting modes (e.g., a strong light mode, a weak light mode, a flashing mode, and a turned off mode).

What is claimed is:

1. A flashlight switching structure, comprising a main body and a light switching assembly threadedly connected to an upper end of a neck of the main body, the flashlight switching structure being characterized in that:

the light switching assembly comprises a positioning element, a plate connected with a reed switch, a partition plate, an annular element, a resilient element, and a cap, the positioning element having an upper section to which the plate connected with the reed switch and the partition plate are connected in such a way that the plate connected with the reed switch is spaced from the partition plate, the positioning element being received in a space defined at an upper end of the main body, the annular element having an inner periphery provided with a magnet at a predetermined position, the annular element being mounted around an upper section of a flange provided at a lower end of the neck of the main body, the flange having a predetermined section formed with a groove corresponding in position to the annular element, the resilient element being received in the groove so that the annular element is resiliently rotatable with respect to the main body, the annular element having an outer periphery formed with a receiving space, the receiving space diminishing in size outward, wherein when the receiving space is aligned with a recess concavely provided at a predetermined peripheral portion of the main body, a protruding block can be engaged in both the receiving space and the recess to prevent the annular element from being rotated, the cap having a threaded inner periphery for threaded connection with an externally threaded portion at the upper end of the neck of the main body;

wherein the annular element is manually rotated to drive the magnet connected thereto to a position in which the reed switch connected to the positioning element in the main body is subjected to magnetic attraction of the magnet, and the annular element is subsequently released so that the magnet is driven back in position by a restoring force of the resilient element, thus the rotating and the releasing of the annular element enabling switching between predetermined lighting modes of a flashlight incorporating the flashlight switching structure, the predetermined lighting modes comprising a strong light mode, a weak light mode, a flashing mode, and a turned off mode.

2. The flashlight switching structure of claim 1, wherein the protruding block is received in the receiving space formed on the outer periphery of the annular element, and once the protruding block is moved partially into the recess provided at the predetermined peripheral portion of the main body upon alignment between the receiving space and the recess, the annular element is prevented from being rotated, and the flashlight is thus prevented from being inadvertently triggered.

3. The flashlight switching structure of claim 1, wherein the resilient element received in the groove formed in the predetermined section of the flange is a spring.

4. The flashlight switching structure of claim 1, wherein the upper section of the positioning element is provided with two relatively low projections which are opposite each other and two relatively high projections which are opposite each other and alternate with the relatively low projections, thus allowing the plate connected with the reed switch and the partition plate to be spaced from each other when connected to the upper section of the positioning element, and wherein the positioning element has an upper periphery provided with a plurality of pressing portions, the pressing portions being arranged at a predetermined spacing and projecting outward so as for the positioning element to fit tightly in the space at the upper end of the main body.

* * * * *